US011158917B2

(12) United States Patent
Aleksov et al.

(10) Patent No.: US 11,158,917 B2
(45) Date of Patent: Oct. 26, 2021

(54) DUAL-SUBSTRATE WAVEGUIDE FILTER

(71) Applicant: Intel Corporation, Santa Clara, CA (US)

(72) Inventors: Aleksandar Aleksov, Chandler, AZ (US); Telesphor Kamgaing, Chandler, AZ (US); Georgios Dogiamis, Chandler, AZ (US); Feras Eid, Chandler, AZ (US); Johanna M. Swan, Scottsdale, AZ (US)

(73) Assignee: Intel Corporation, Santa Clara, CA (US)

( * ) Notice: Subject to any disclaimer, the term of this patent is extended or adjusted under 35 U.S.C. 154(b) by 33 days.

(21) Appl. No.: 16/577,478

(22) Filed: Sep. 20, 2019

(65) Prior Publication Data

US 2021/0091443 A1 Mar. 25, 2021

(51) Int. Cl.

| | |
|---|---|
| ***H01P 1/203*** | (2006.01) |
| ***H01P 7/06*** | (2006.01) |
| ***H01P 11/00*** | (2006.01) |
| ***H01P 1/20*** | (2006.01) |
| ***H01P 7/10*** | (2006.01) |

(52) U.S. Cl.

CPC ..... *H01P 1/20327* (2013.01); *H01P 1/2002* (2013.01); *H01P 7/065* (2013.01); *H01P 7/10* (2013.01); *H01P 11/008* (2013.01)

(58) Field of Classification Search

CPC .. H01P 1/2002; H01P 1/20327; H01P 11/008; H01P 7/065; H01P 7/10

USPC ..... 333/208, 209

See application file for complete search history.

(56) References Cited

U.S. PATENT DOCUMENTS

| | | | | |
|---|---|---|---|---|
| 2005/0269385 | A1* | 12/2005 | Chen | B23K 35/26 228/180.22 |
| 2009/0128263 | A1* | 5/2009 | Hesselbarth | H01P 1/2053 333/230 |
| 2010/0308925 | A1* | 12/2010 | Song | H01P 1/208 331/96 |
| 2011/0204991 | A1* | 8/2011 | Rao | H01P 1/213 333/101 |
| 2019/0173153 | A1* | 6/2019 | Gudeman | H01P 1/2088 |

* cited by examiner

*Primary Examiner* — Rakesh B Patel

(74) *Attorney, Agent, or Firm* — Patent Capital Group

(57) ABSTRACT

Embodiments may relate to an assembly that includes a first package substrate with a first electromagnetic cavity. The assembly may further include a second package substrate with a second electromagnetic cavity that is adjacent to the first electromagnetic cavity. The first and second electromagnetic cavities may form a millimeter wave (mmWave) resonant cavity of a mmWave filter. Other embodiments may be described or claimed.

19 Claims, 13 Drawing Sheets

DUAL-SUBSTRATE WAVEGUIDE FILTER

BACKGROUND

Radio frequency (RF) filters may be used in wireless applications such as fifth generation (5G) wireless transmission. Such filters are generally machined filters that may be connected to the rest of the RF system by waveguide structures. Such machined filters may also have size, weight, or cost disadvantages.

DETAILED DESCRIPTION

Figure 1:
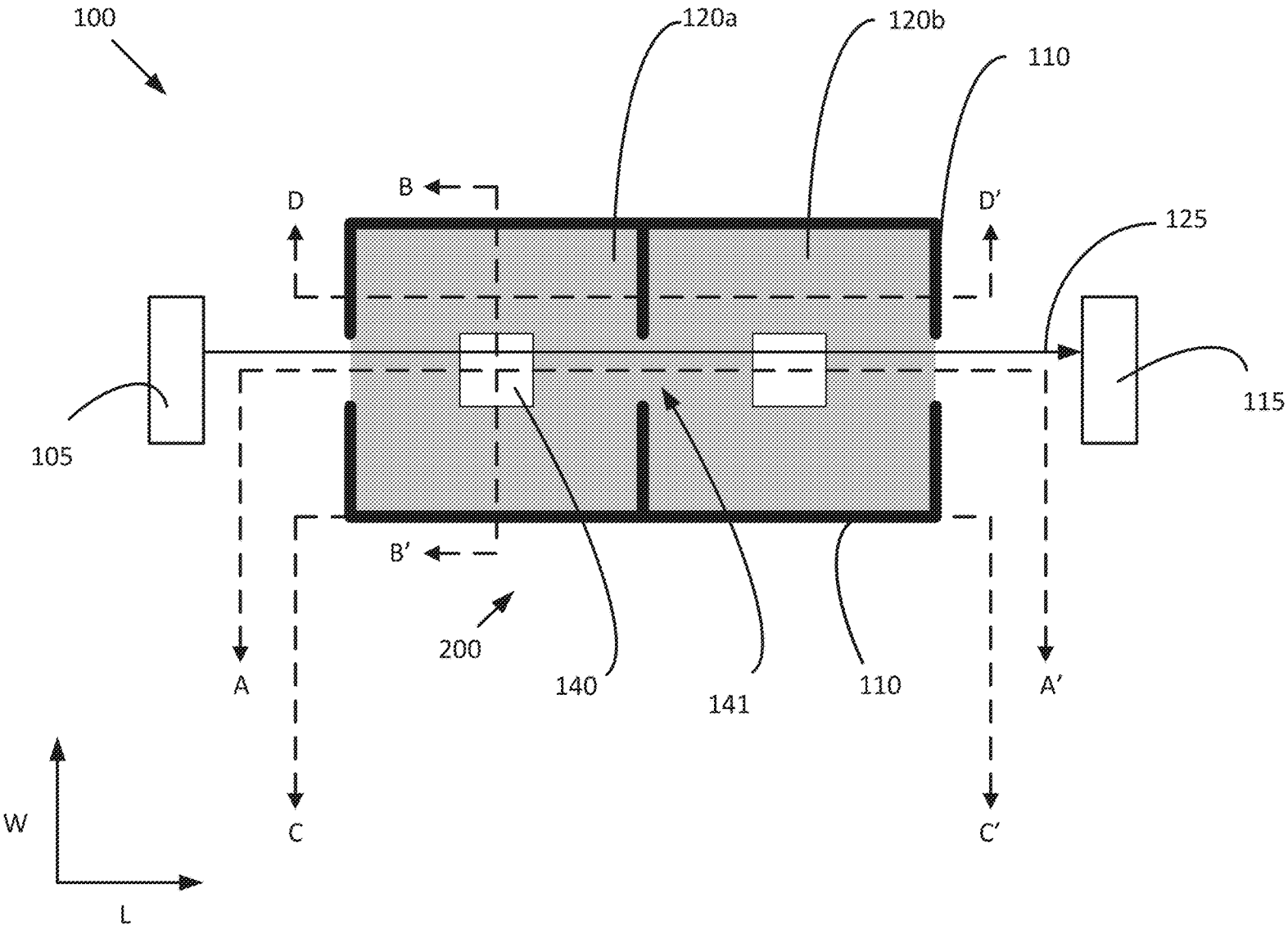
FIG. 1 depicts a simplified example top-down view of a computing system that may include a dual-substrate millimeter wave (mmWave) filter, in accordance with various embodiments.

In the following detailed description, reference is made to the accompanying drawings which form a part hereof, wherein like numerals designate like parts throughout, and in which is shown by way of illustration embodiments in which the subject matter of the present disclosure may be practiced. It is to be understood that other embodiments may be utilized and structural or logical changes may be made without departing from the scope of the present disclosure. Therefore, the following detailed description is not to be taken in a limiting sense.

For the purposes of the present disclosure, the phrase "A or B" means (A), (B), or (A and B). For the purposes of the present disclosure, the phrase "A, B, or C" means (A), (B), (C), (A and B), (A and C), (B and C), or (A, B and C).

The description may use perspective-based descriptions such as top/bottom, in/out, over/under, and the like. Such descriptions are merely used to facilitate the discussion and are not intended to restrict the application of embodiments described herein to any particular orientation.

The description may use the phrases "in an embodiment," or "in embodiments," which may each refer to one or more of the same or different embodiments. Furthermore, the terms "comprising," "including," "having," and the like, as used with respect to embodiments of the present disclosure, are synonymous.

The term "coupled with," along with its derivatives, may be used herein. "Coupled" may mean one or more of the following. "Coupled" may mean that two or more elements are in direct physical or electrical contact. However, "coupled" may also mean that two or more elements indirectly contact each other, but yet still cooperate or interact with each other, and may mean that one or more other elements are coupled or connected between the elements that are said to be coupled with each other. The term "directly coupled" may mean that two or elements are in direct contact.

In various embodiments, the phrase "a first feature [[formed/deposited/disposed/etc.]] on a second feature," may mean that the first feature is formed/deposited/disposed/etc. over the feature layer, and at least a part of the first feature may be in direct contact (e.g., direct physical or electrical contact) or indirect contact (e.g., having one or more other features between the first feature and the second feature) with at least a part of the second feature.

Various operations may be described as multiple discrete operations in turn, in a manner that is most helpful in understanding the claimed subject matter. However, the order of description should not be construed as to imply that these operations are necessarily order dependent.

Embodiments herein may be described with respect to various Figures. Unless explicitly stated, the dimensions of the Figures are intended to be simplified illustrative examples, rather than depictions of relative dimensions. For example, various lengths/widths/heights of elements in the Figures may not be drawn to scale unless indicated otherwise. Additionally, some schematic illustrations of example structures of various devices and assemblies described herein may be shown with precise right angles and straight lines, but it is to be understood that such schematic illustrations may not reflect real-life process limitations which may cause the features to not look so "ideal" when any of the structures described herein are examined, e.g., using scanning electron microscopy (SEM) images or transmission electron microscope (TEM) images. In such images of real structures, possible processing defects could also be visible, e.g., not-perfectly straight edges of materials, tapered vias or other openings, inadvertent rounding of corners or variations in thicknesses of different material layers, occasional screw, edge, or combination dislocations within the crystalline region, and/or occasional dislocation defects of single atoms or clusters of atoms. There may be other defects not listed here but that are common within the field of device fabrication.

As noted above, legacy RF filters may typically be machined filters that are typically built on a single substrate, and which may be connected to the rest of the RF system by waveguides. Such machined filters may also have size, weight, or cost disadvantages. This may make such machined filters undesirable for use in RF systems-in-package (SiPs) where size or weight may be important considerations. Additionally, the legacy machined filters are typically built on a single substrate.

Embodiments herein may relate to RF filters that use a stacked substrate package technology for filter performance. In embodiments herein, the resultant filters may be referred to as "dual-substrate" filters. In some embodiments, the substrates may be organic substrates. The filters discussed herein may be particularly useful for millimeter wave (mmWave) applications related to frequencies between approximately 30 gigahertz (GHz) and approximately 300 GHz. In some embodiments, the filters may be particularly useful for frequencies up to 1 THz. Embodiments herein may offer significant precision or manufacturing tolerance advantages over legacy filters. Embodiments herein may also be desirable at increasing frequencies or through the implementation of advanced dielectric materials with specific tailored dielectric loss or dielectric number values. In sum, embodiments herein may enable high-performance mmWave filters for 5G applications that are light, integrated, have a relatively small form factor, and advanced filtering performance.

FIG. 1 depicts a simplified example top-down view of a computing system 100 that may include a dual-substrate mmWave filter 200, in accordance with various embodiments. The dual-substrate mmWave filter may include or be based on coupled resonator electromagnetic cavities. Embodiments may include stacking a package substrate or a substrate patch (which may be coreless or cored) on top of a base substrate. The base substrate may not only be used for filters but also as a RF SiP package. Generally, FIG. 1 is intended to be a very simplified high-level example of one embodiment of a dual-substrate filter. It will be understood that each and every element of the dual-substrate filter, or the system in general, may not be depicted in FIG. 1.

Subsequent FIGS. 2-5, 12, and 13 may further refer to elements of FIG. 1. Specifically, the subsequent FIGS. 2-5, 12, and 13 may depict cross-sectional views taken along various of the marked axes of FIG. 1. To aid in understanding, three-dimensional perpendicular axes may be used to further add consistency to the various views. The axes may be the length L, the width W, and the height Z. It will be understood, of course, that these names (length, width, and height) are made with reference to the orientation of the Figures in the drawings and are so marked for the sake of consistent reference, and are not intended to specifically limit embodiments to a single orientation.

The computing system 100 may include a signal input 105 and a signal output 115. The signal input 105 may be operable to generate a mmWave electromagnetic signal, and provide the signal to the mmWave filter 200. The signal input 105 may, for example, be coupled to an antenna or some other element which receives an electromagnetic signal with a mmWave frequency and passes the signal on, with or without processing, to the mmWave filter 200 which may provide filtering and then provide the filtered signal to the signal output 115. The signal output 115 may then perform further processing of the filtered signal or provide the filtered signal to another element of the 5G RF device for further processing. This sort of pathway may be used, for example, in a receiver pathway of a 5G RF device. In other embodiments, the signal input 105 may generate a mmWave electromagnetic signal which is then provided to the mmWave filter 200 before being passed to the signal output 115 which may then facilitate transmission of the filtered signal through, for example, an antenna. This embodiment may be used, for example, in a transmission pathway of a 5G RF device.

In this depiction, the mmWave electromagnetic signal is depicted as the arrowed line 125. It will be understood that in the depiction, the arrowed line 125 is offset from the center of the mmWave filter 200. This offset is for the purpose of clear depiction of both the arrowed line 125 and the axis A-A' which is discussed further with respect to FIG. 2. However, in real-world embodiments, the arrowed line 125 that represents the propagation of the mmWave electromagnetic signal from the signal input 105 through the mmWave filter 200 to the signal output 115 may be more centrally located than depicted in FIG. 1.

The mmWave filter 200 may include two resonant cavities 120*a* and 120*b* (collectively, resonant cavities 120), which may be adjacent to one another. Generally, the resonant cavities 120 may enable signal propagation for signals at frequencies close to the self-resonance frequency of the cavities. Other resonant cavities may be added to the mmWave filter 200 to prevent signal propagation at certain frequencies. Those cavities not shown may be responsible for transmission zeroes. In some embodiments, the cavities responsible for transmission zeroes may not necessarily be along line 125, but rather may be coupled to a different edge of the various cavities 120. Similarly, the signal propagation 125 may not necessarily be linear, but rather in some embodiments certain of the cavities 120 may be coupled in a non-linear fashion. Such coupling may be based on, for example, design targets related to the mmWave filter 200.

As can be seen in FIG. 1, the output of the resonant cavity 120*a* (as indicated by the propagation of the mmWave electromagnetic signal through the mmWave filter 200) may be adjacent to the input of the resonant cavity 120*b*, and coupled with one another by an iris (e.g., an opening) 141. In other words, the mmWave electromagnetic signal may be filtered to a first degree by the resonant cavity 120*a*, and then the resultant signal may be input to the resonant cavity 120*b* where it may be further filtered before being output from the mmWave filter 200 to the signal output 115.

The resonant cavities 120 may each include a load element 140. The load element 140 may be a metal or dielectric structure with a different k-value (which may also be referred to as a "dielectric constant") than the dielectric material of the substrates of the mmWave filter 200. Generally, the load element 140 may help with cavity size reduction of the resonant cavities 120.

Additionally, the resonant cavities 120 may be defined by a filter structure 110, which will be described in greater detail below. The filter structure 110 may be formed of a material such as copper or some other material that serves to constrain the mmWave electromagnetic signal within the mmWave filter 200 so that the mmWave electromagnetic signal propagates through the mmWave filter 200 as intended.

Figure 2:
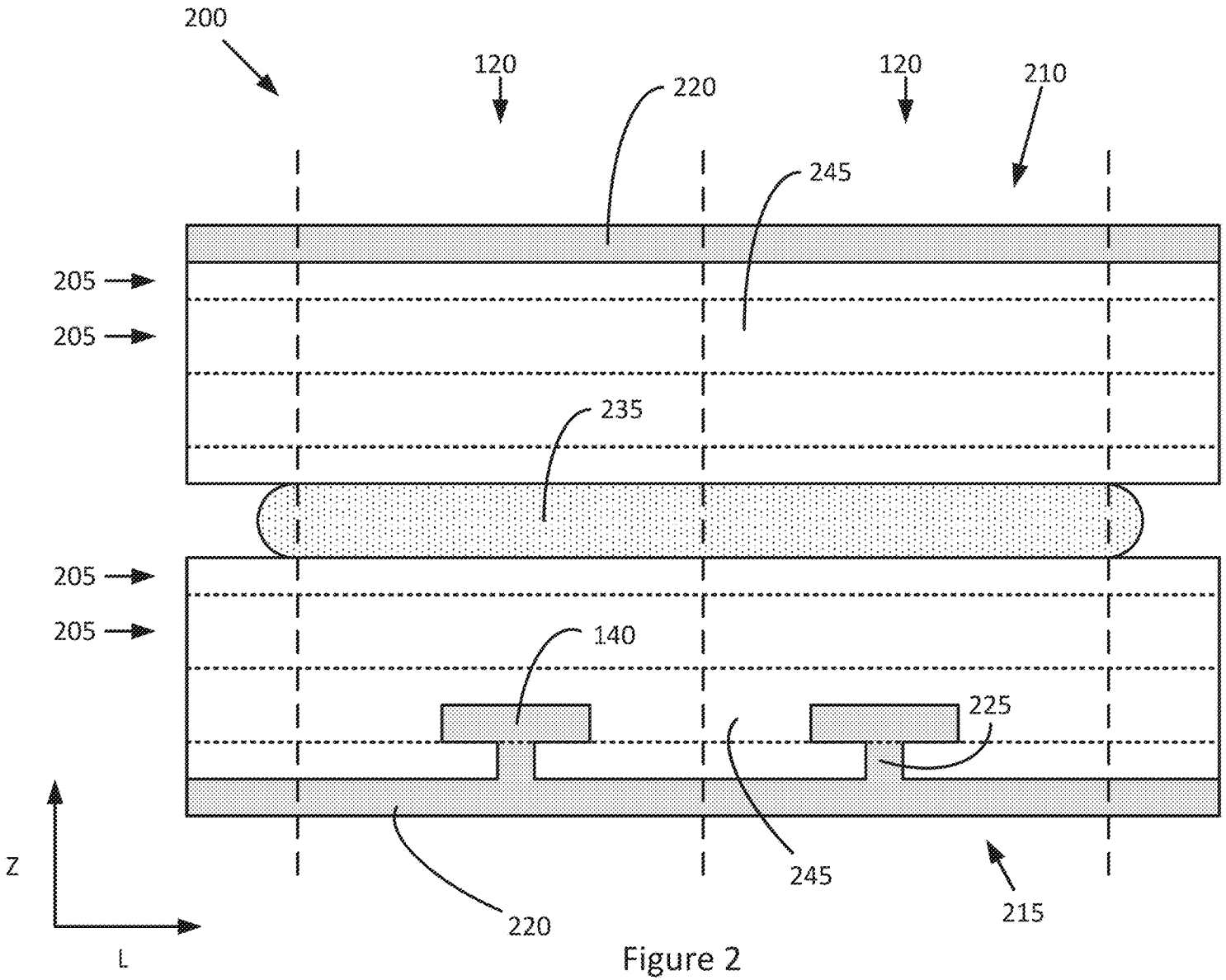
FIG. 2 depicts a simplified example cross-sectional view of the dual-substrate mmWave filter of FIG. 1, in accordance with various embodiments.
Figure 3:
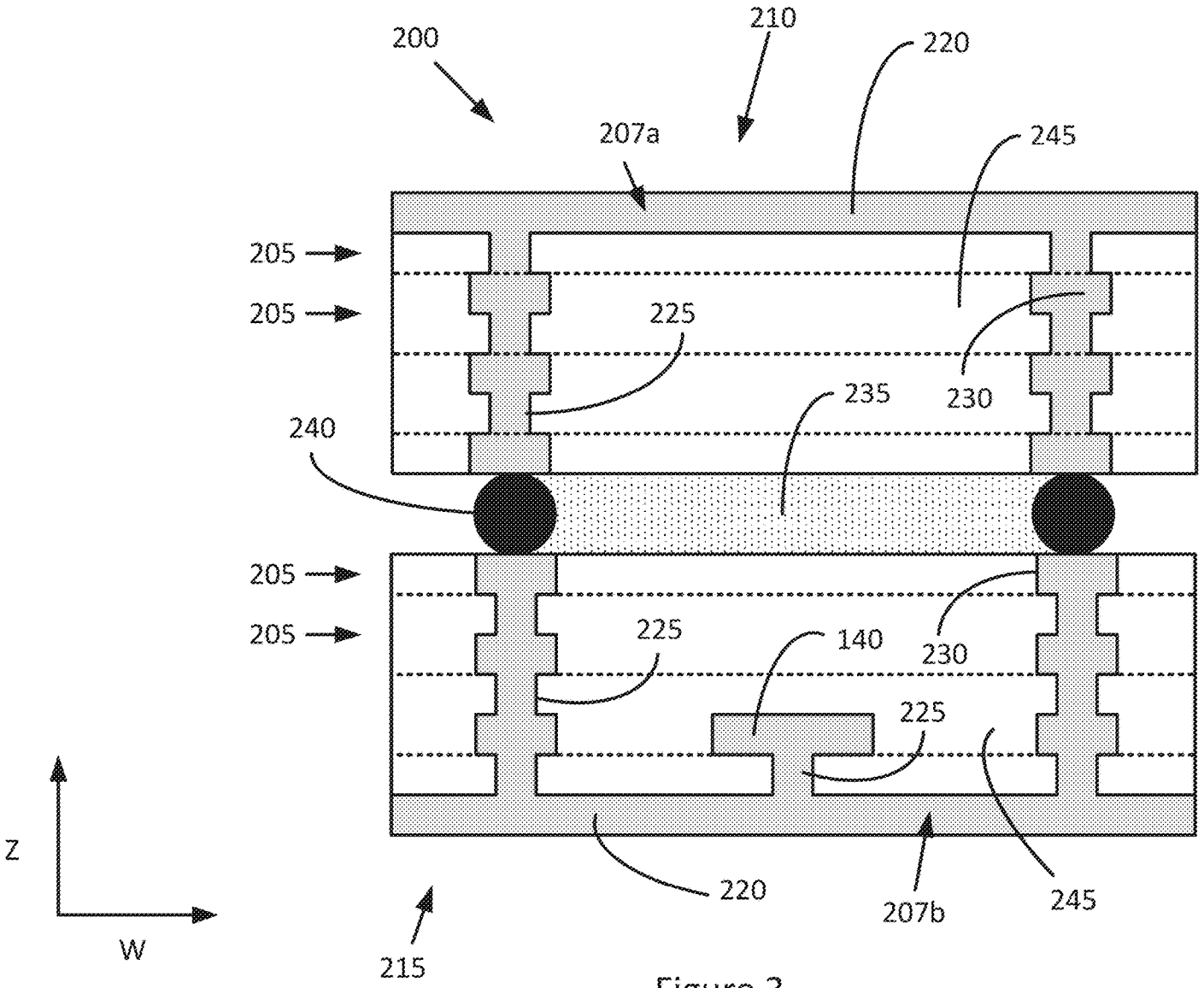
FIG. 3 depicts an alternative simplified example cross-sectional view of the dual-substrate mmWave filter of FIG. 1, in accordance with various embodiments.
Figure 4:
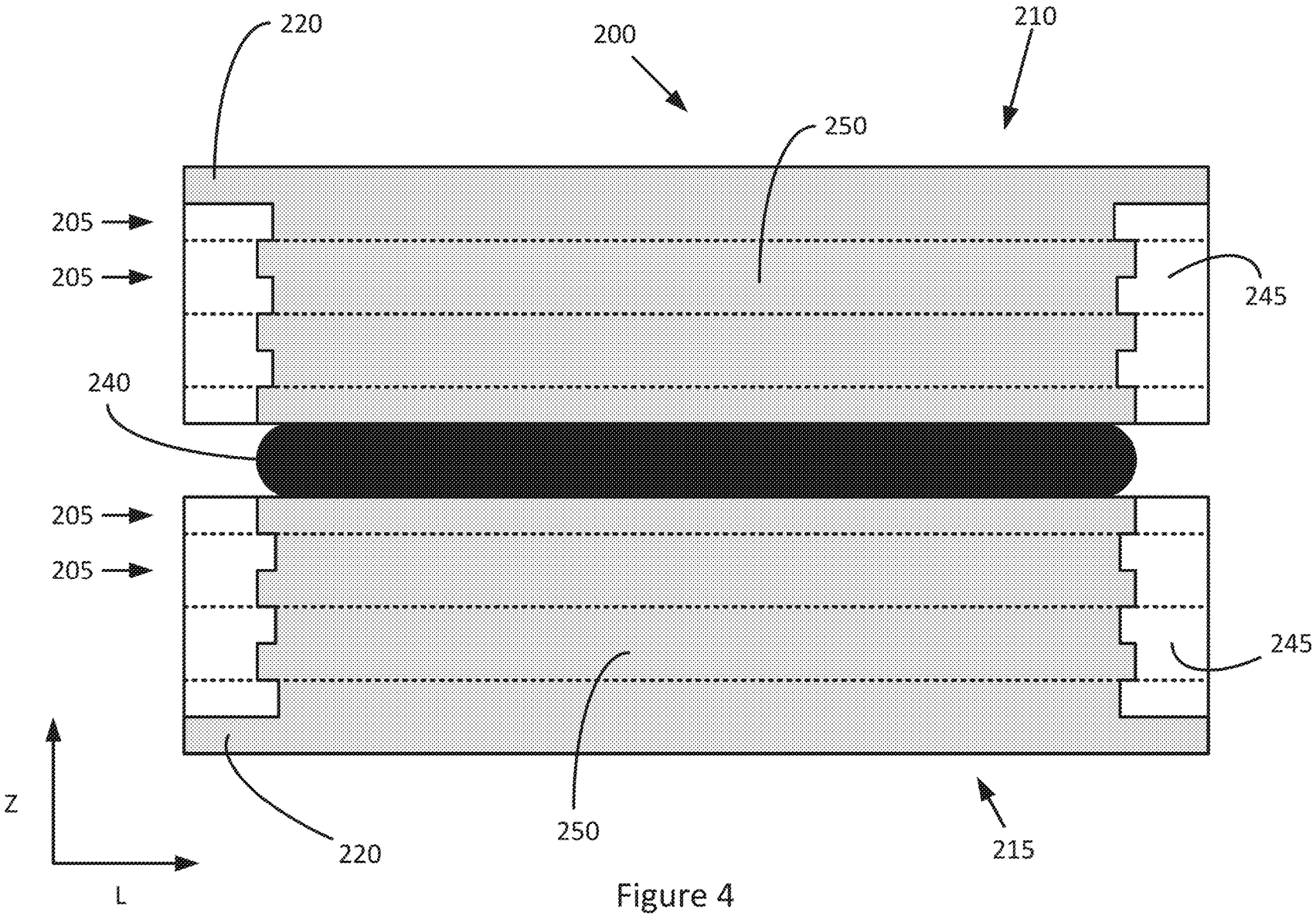
FIG. 4 depicts an alternative simplified example cross-sectional view of the dual-substrate mmWave filter of FIG. 1, in accordance with various embodiments.
Figure 12:
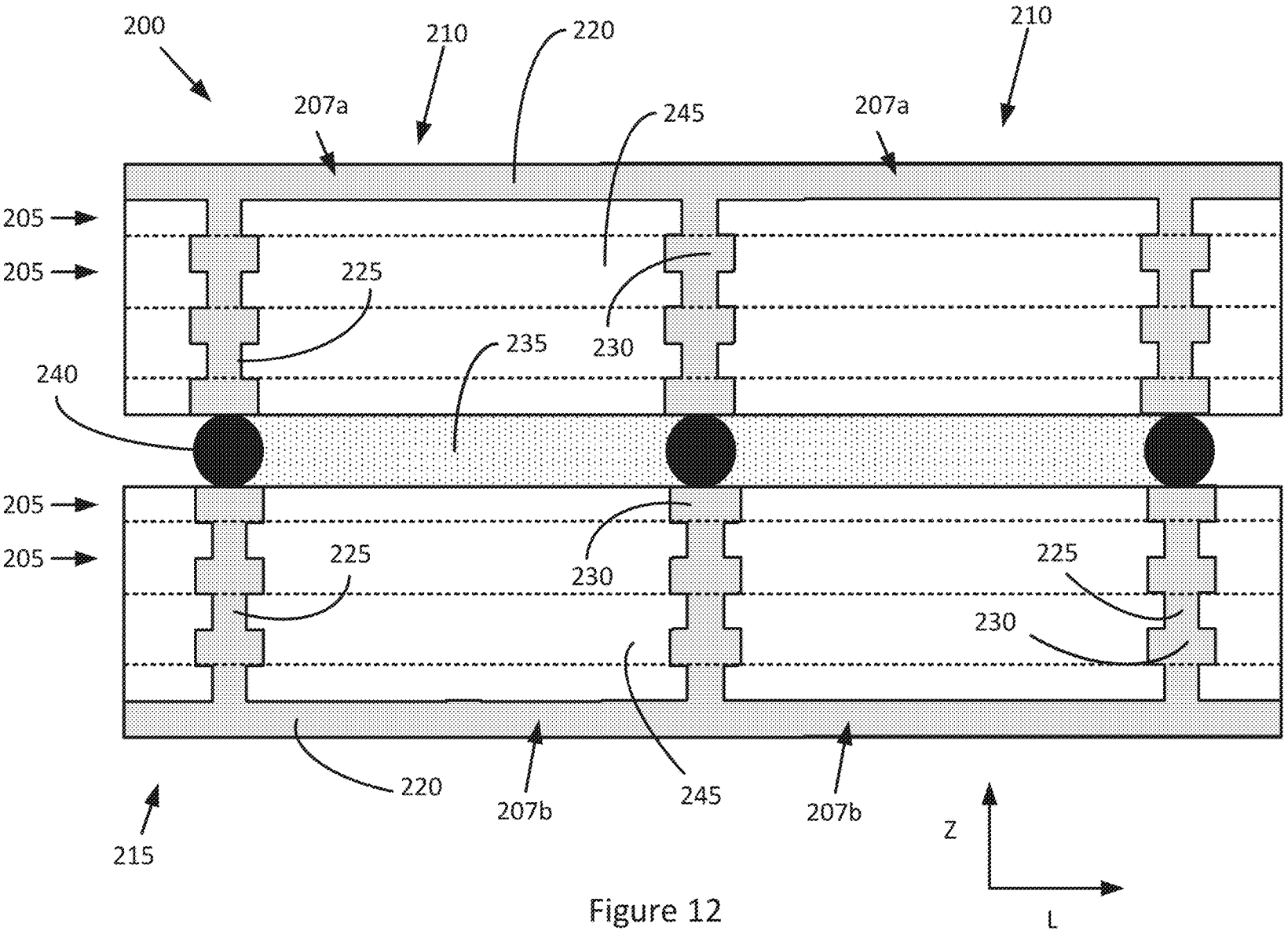
FIG. 12 depicts an alternative simplified example cross-sectional view of the dual-substrate mmWave filter of FIG. 1, in accordance with various embodiments.

FIGS. 2-4 and 12 depict simplified example cross-sectional views of the dual-substrate mmWave filter 200 of FIG. 1, in accordance with various embodiments. Specifically, FIG. 2 depicts a view of the mmWave filter 200 along line A-A'. FIG. 3 depicts a view of the mmWave filter 200 along line B-B'. FIG. 4 depicts a view of the mmWave filter 200 along line C-C'. FIG. 12 depicts a view of the mmWave filter 200 along line D-D'. The mmWave filter 200 may include a number of resonant cavities 120, which are generally logically separated by the vertical dashed lines in FIG. 2.

The mmWave filter 200 may include substrates 210 and 215, which may be positioned opposite one another. Generally, the substrates 210 and 215 may create a relatively large resonant cavity 120 when they are combined together. The larger resonant cavity may be useful for lower frequencies of operation, where cavities may become larger (due to a larger wavelength) and can be more compact if the k-value of the dielectric material of the substrates 210/215 increases.

Each of the substrates 210/215 may include a plurality of layers 205 of substrate material 245. The substrate material 245 may be, for example, a build-up film or some other type of dielectric material. Specifically, it may be desirable to use a low loss or high-k organic build-up film or other material. For example, such materials may desirably have a k-value on the order of between approximately 5 and approximately 10. In some embodiments the materials may have a k-value on the order of between approximately 10 and approximately 20. Other embodiments may use a material with a lower k-value such as a k-value on the order of between approximately 3 and approximately 4. For example, in some embodiments the material may have a k-value on the order of between approximately 3.2 and approximately 3.4. These materials may result in a relatively low loss tangent on the order of less than approximately 0.004 may be used in some embodiments.

In some embodiments substrates 210 and 215 may have the same type of substrate material 245, whereas in other embodiments the substrate material 245 of substrate 210 may be different than the substrate material 245 of substrate 215. In some embodiments the substrate material 245 may be generally a unitary mass, in which case the respective layers 205 may be generally logical subdivisions of the material, rather than physical. In other embodiments the layers 205 may be formed separately from one another such that there are distinct physical differences between one layer 205 and another. Each of the layers 205 may have a z-height (as measured in a direction parallel to the axis Z) of between approximately 10 micrometers ("microns" or "μm") and approximately 60 microns. The mmWave filter 200 may have an overall z-height of between approximately 200 microns and approximately 800 microns. In some embodiments, the mmWave filter 200 may have an overall z-height of between approximately 240 microns and approximately 400 microns. In some embodiments the mmWave filter 200 may have a gap height (i.e., a distance between substrates 210 and 215) of between approximately 10 and approximately 100 microns, however in other embodiments the gap height may be larger or smaller dependent on manufacturing capabilities, component design, size of interconnects 240, the frequency of operation, etc. It will be noted that this z-height may be higher than, for example, some legacy filters. This increased height may increase the efficiency of the mmWave filter 200. Additionally, the increased height may be based, at least in part, on the use of the dual-substrate architecture, which may allow for a z-height greater than that which may be possible through the use of a single substrate.

Figure 5:
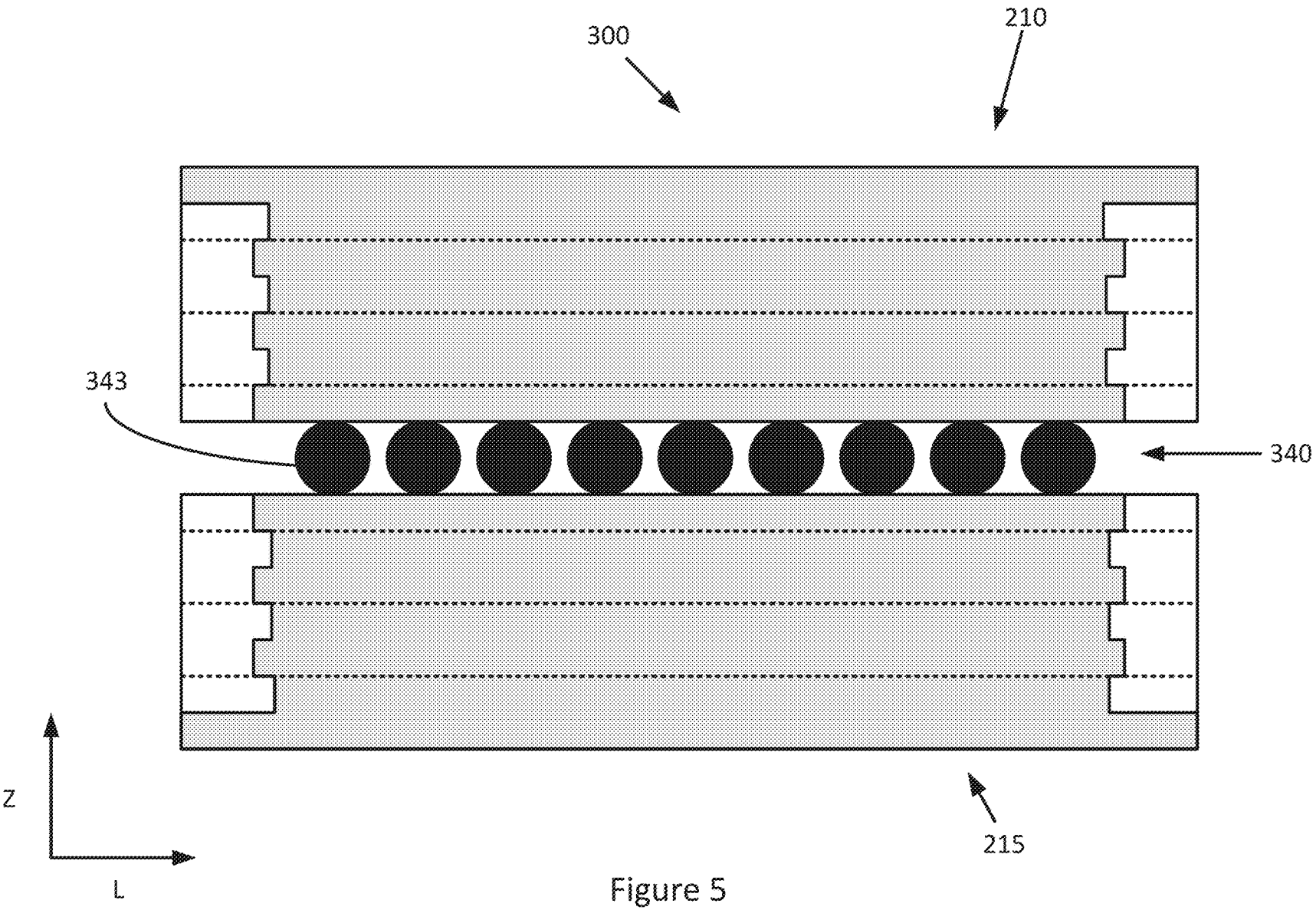
FIG. 5 depicts an alternative simplified example cross-sectional view of a dual-substrate mmWave filter, in accordance with various embodiments.

The substrates 210 and 215 may be coupled to one another by an interconnect structure 240. The interconnect structure 240 may be formed of a solder material such as tin, silver, lead, copper, compounds thereof, etc. The interconnect structure 240 may be a unitary element that is placed between the substrates 210/215, or the interconnect structure 240 may include a plurality of solder interconnect elements. FIGS. 2-4 and 12 depict an example embodiment where the interconnect structure 240 is formed of a single interconnect element. FIG. 5, as will be discussed in further detail below, depicts an example of an interconnect structure that includes a plurality of interconnect elements.

Through use of the interconnect structures 240 that join the substrates 210 and 215 together, a cavity 235 may be formed between the two substrates 210/215. In some embodiments, air may be a desirable material to place in the cavity 235, because air may have the lowest tan δ (i.e., the lowest dissipation factor). However, in other embodiments the cavity 235 may be filled with a material such as an organic material, underfill, a mold material, or some other material that has properties tailored to a 5G RF application. Such properties may include, for example, a relatively low loss coefficient and a desirable k-value as described above with respect to the substrate material 245.

Respective layers 205 of the substrates 210/215 may include a number of shielding elements. The shielding elements may be formed of, for example, copper or some other appropriate electromagnetically shielding material. Generally, the purpose of the shielding elements may be to limit the propagation of the mmWave electromagnetic signal through the mmWave filter 200 to a desired propagation path. The shielding elements may be formed of, or include, a number of elements such as vias, traces, pads, microstrips, striplines, plates, sidewalls, etc. FIGS. 2-4 and 12 depict a number of such shielding elements.

Specifically, the shielding elements may include vias such as vias 225 or traces such as traces 230. The shielding elements may additionally include sidewalls such as sidewalls 250. The various shielding elements such as the vias 225, traces 230, or sidewalls 250 may be formed through, for example, lithographic etching and plating, mechanical drilling and plating, or some other technique. The shielding elements may further include plates such as plates 220. It will be understood that the various shielding elements may not be depicted to scale, but rather are shown for the sake of discussion and explanation.

In some embodiments, the various shielding elements may be coupled to one another. For example, in substrates 210 and 215, the vias 225, traces 230, sidewall 250, and plate 220 of the respective substrates may be coupled to one another to form a unitary shielding structure. As may be seen in FIGS. 2-4 and 12, the unitary shielding structure may generally encapsulate the resonant cavities 120. As may be seen in FIGS. 1 and 12, the sidewall 250 may extend at least partially to form a separation between the two resonant cavities 120. As such, the substrates 210 and 215 may include two electromagnetic cavities, one for each of resonant cavities 120.

It will be understood that, as used herein, the term "electromagnetic cavity" may refer to a cavity of a single substrate. The two electromagnetic cavities of each of the substrates (e.g., of substrates 210 and 215) may together define a resonant cavity such as resonant cavities 120*a* or 120*b*.

As described, each of substrates 210 and 215 may include an electromagnetic cavity which may be generally defined by or with respect to the various shielding elements. The electromagnetic cavities of substrates 210 and 215 may be generally aligned with one another to form the resonant cavities 120. The resonant cavities 120 may be further defined by the interconnect structure 240 which may act to both physically couple the substrates 210/215 and to electromagnetically seal the resonant cavities 120 at the junction of the substrates 210 and 215.

The resonant cavities 120 may further include a load element 140. As shown, the load element 140 may be formed of the same material as the various shielding structures, and may be coupled with the plate 220 of substrate 215 by a via 225. However, in other embodiments the load elements 140 may be an element of the substrate 210, may be located at a different layer 205 of the substrates 210/215, may have a different shape or width, etc. It will be understood that in some embodiments one or more of the resonant cavities 120 may not include a load element 140. In some embodiments the load element 140 may be of a different material than the material of the substrate 210 and may be, for example, a conductor (e.g., a metal-based conductor) or an insulator (e.g., a dielectric-based material). The inclusion, shape, material choice, or size of the load element 140 may be based on, for example, the specific frequency at which a given resonant cavity is to resonate or other design considerations.

An embodiment where the interconnect structure includes a plurality of interconnect elements is depicted with respect to FIG. 5. Specifically, FIG. 5 depicts an alternative simplified example cross-sectional view of a dual-substrate mmWave filter 300, in accordance with various embodiments. The view may be taken along line C-C' of FIG. 1. The mmWave filter 300 may be generally similar to, and share one or more characteristics of, mmWave filter 200. Specifically, mmWave filter 300 may include substrates 210 and 215. However, rather than a unitary interconnect structure 240, the mmWave filter 300 may include an interconnect structure 340 that includes a plurality of interconnect elements 345. Respective ones of the interconnect elements 345 may be, for example, solder bumps or solder balls, though other types of interconnect elements may be present in other embodiments. The interconnect elements 345 may be formed of a solder material similar to that described with respect to interconnect structure 240.

Similarly to interconnect structure 240, the interconnect structure 340 may serve, in conjunction with the various shielding elements of the mmWave filter 300, to constrain the propagation of the mmWave electromagnetic signal through the mmWave filter 300. As such, respective interconnect elements 345 of the interconnect structure 340 may be spaced apart such that they still provide electromagnetic shielding and constraint of the mmWave electromagnetic signal. More specifically, the interconnect elements 345 may have a pitch (e.g., a distance from the center of one interconnect element 345 to the center of another interconnect element 345) between approximately 30 microns and approximately 300 microns. In some embodiments, this pitch may provide for a gap height (e.g., a distance between substrates 210 and 215) of between approximately 10 and approximately 100 microns. However, it will be understood that in other embodiments the pitch of the interconnect elements 345 or the gap height between substrates 210 and 215 may be larger or smaller based on factors such as the diameter of the interconnect elements 345 themselves, the frequency of the mmWave electromagnetic signal, the material used, or other factors.

As described above, the relatively large resonant cavities 120 that result from the alignment of substrates 210 and 215 may be desirable for lower frequencies of operation. However, as frequencies increase to the sub-THz and THz range (e.g., on the order of approximately 900 GHz to 1 THz), the relatively large cavity may not be needed. Rather, for these relatively high frequencies, it may be desirable to stack two individual cavities on top of each other. The two cavities may be coupled together electromagnetically through another iris, e.g., an iris that is along the Z-axis. In general cavity stacking may be implemented for filters operating at any frequency and for implementation in platforms or devices, where footprint is a constraint.

Figure 13:
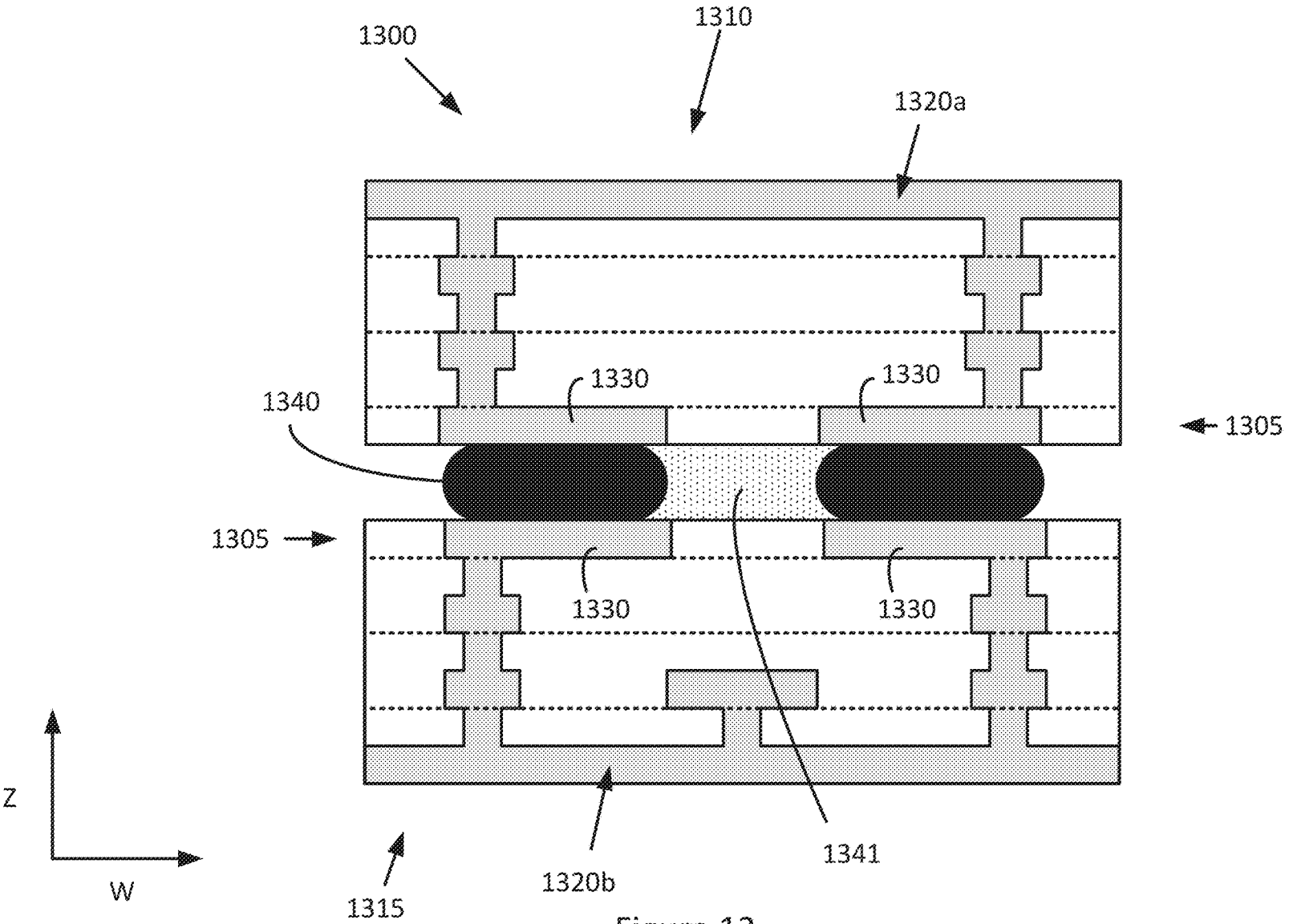
FIG. 13 depicts an alternative simplified example cross-sectional view of a dual-substrate mmWave filter, in accordance with various embodiments.

FIG. 13 depicts an alternative simplified example cross-sectional view of a dual-substrate mmWave filter 1300, in accordance with various embodiments. Specifically, FIG. 13 depicts an example of such a configuration where two individual resonant cavities may be stacked on top of one another. It will be understood that, for the sake of brevity and lack of redundancy, each and every element of FIG. 13 may not be described. However, elements of FIG. 13 that are similar to those of previous Figures may share one or more characteristics with those elements.

The mmWave filter 1300 may include substrates 1310 and 1315, which may be respectively similar to, and share one or more characteristics with, substrates 210 and 215. The substrates 1310 and 1315 may be coupled to one another by one or more interconnects 1340, which may be similar to, and share one or more characteristics with, interconnects 240.

As can be seen, the respective substrates 1310 and 1315 may each have a resonant cavity 1320*a* and 1320*b* defined by the shielding structures of the respective substrates 1310 and 1315. In this case, the resonant cavity of the substrate and the electromagnetic cavity of the substrate may be the same. The resonant cavities 1320*a* and 1320*b* may be electromagnetically coupled with one another by an iris 1341 that is defined by the shielding structures of each of the substrates 1310 and 1315. Specifically, the iris 1341 may be defined by extended pads 1330 in the layer 1305 of the substrate that is closest to the other substrate.

It will be understood that the FIGS. 1-5, 12, and 13 are intended as example Figures, and variations from the Figures may be present in various embodiments. For example, although only two resonant cavities 120 are depicted in the Figures, other embodiments may have more or fewer resonant cavities 120. Additionally, although a certain number of layers 205, load elements 140, interconnect elements 345, etc. may be depicted, other embodiments may have more or fewer of various of the depicted elements. Additionally, as previously noted, various of the elements are depicted for the sake of discussion, however specific dimensions of certain of the elements, and particularly relative dimensions along one or more of the depicted axes, may be different in other embodiments. It will also be understood that elements of various of the Figures may be combined with one another. For example, a mmWave filter may be designed such that it includes the dual-substrate resonant cavities 120 in addition to the stacked single-substrate resonant cavities 1320*a* and 1320*b*. Other variations may be present in other embodiments.

Figure 6:
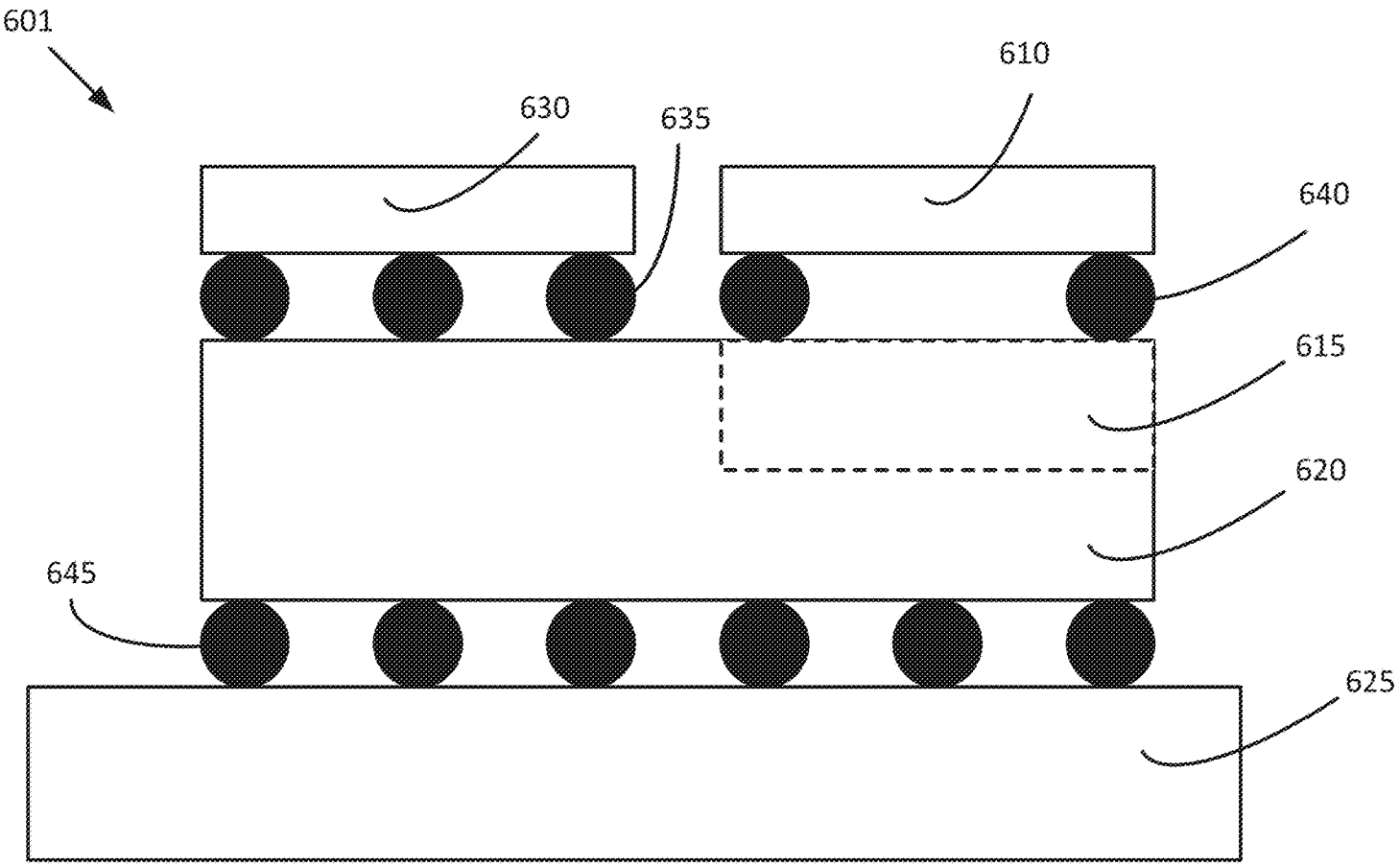
FIG. 6 depicts a simplified example RF assembly that includes a dual-substrate mmWave filter, in accordance with various embodiments.

Considering the package-to-package assembly of the mmWave filter, the two packages (top and bottom or top and base) may be generally the same size as depicted, for example, in FIGS. 2-5. In other embodiments, the top substrate may be a different size than the bottom substrate (or base substrate). FIG. 6 depicts a simplified example RF assembly 601 that includes a dual-substrate mmWave filter, in accordance with various embodiments. In the RF assembly 601, the base substrate may be larger than the top substrate, and so may allow for a more complex RF SiP.

The RF assembly 601 may include a substrate 610 which may be similar to, and share one or more characteristics with, substrate 210. The substrate 610 may, in this embodiment, be referred to as a "patch."

Additionally, the RF assembly 601 may include a substrate 620. The substrate 620 may be a cored or coreless substrate, and may include a plurality of layers of a dielectric substrate material similar to substrate material 245 or some other substrate material. The substrate 620 may include one or more conductive elements such as various conductive vias, traces, microstrips, striplines, pads, etc. which may communicatively couple various elements of the substrate 620 to one another, or may communicatively couple the various elements to other components of an electrical device to which the substrate 620 is coupled. The substrate 620 may additionally include one or more active or passive elements either positioned within, partially within, or on the substrate 620. Such passive elements may be or include, for example, capacitors, resistors, inductors, etc. An active element may be similar to, for example active element 630. The active element 630 may be or may include a processing core, a memory, a logic, or some other active element of an electronic device. As shown, the active element 630 may be coupled to the substrate 620, however in other embodiments the active element 630 may be positioned at least partially within the substrate 620. In some embodiments, the active element 630 may be, or may be communicatively coupled with, the signal input 105 or the signal output 115 of FIG. 1.

The active element 630 may be coupled with the substrate 620 by one or more interconnects 635. The interconnects 635 may be, for example, formed of a solder material similar to that discussed with respect to interconnect structure 240. In some embodiments, the interconnects may be balls of a ball grid array (BGA), while in other embodiments the interconnects may be a different type of interconnect. The interconnects 635 may allow for physical coupling, communicative coupling, or both of the active element 630 and the substrate 620. The interconnects 635 may be generally referred to as "first level interconnects" (FLIs).

At least a portion 615 of the substrate 620 may be similar to, and share one or more characteristics with, substrate 215. In other words, at least a portion 615 of the substrate 620 may be generally surrounded by shielding elements such as the plate 220, vias 225, traces 230, etc. of FIGS. 2-4. In this way, a substrate such as substrate 215 may be positioned within, and be part of, a substrate such as substrate 620. The substrate 610 and the portion 615 may be coupled by an interconnect structure 640, which may be similar to, and share one or more characteristics with, interconnect structures 240 or 340.

The RF assembly 601 may be further coupled to a board 625. The board 625 may be a substrate that is similar to, for example, substrate 620. Specifically, the board 625 may be cored or coreless, may include one or more conductive, passive, or active elements, etc. The board 625 may be referred to as an interposer, a motherboard, a printed circuit board (PCB) or some other type of substrate.

The RF assembly 601, and particularly the substrate 620, may be coupled with board 625 by one or more interconnects 645. The interconnects 645 may be generally similar to, and share one or more characteristics with, interconnects 635. Specifically, the interconnects 645 may be formed of a solder material similar to that discussed with respect to interconnect structure 240. Similarly, the interconnects 645 may be solder bumps or solder balls in a BGA, pins of a pin grid array (PGA), elements of a land grid array (LGA) or solder grid array (SGA), a socket, or some other type of interconnect. Generally, the interconnects 645 may physically or communicatively couple the substrate 620 to the board 625.

Figure 7:
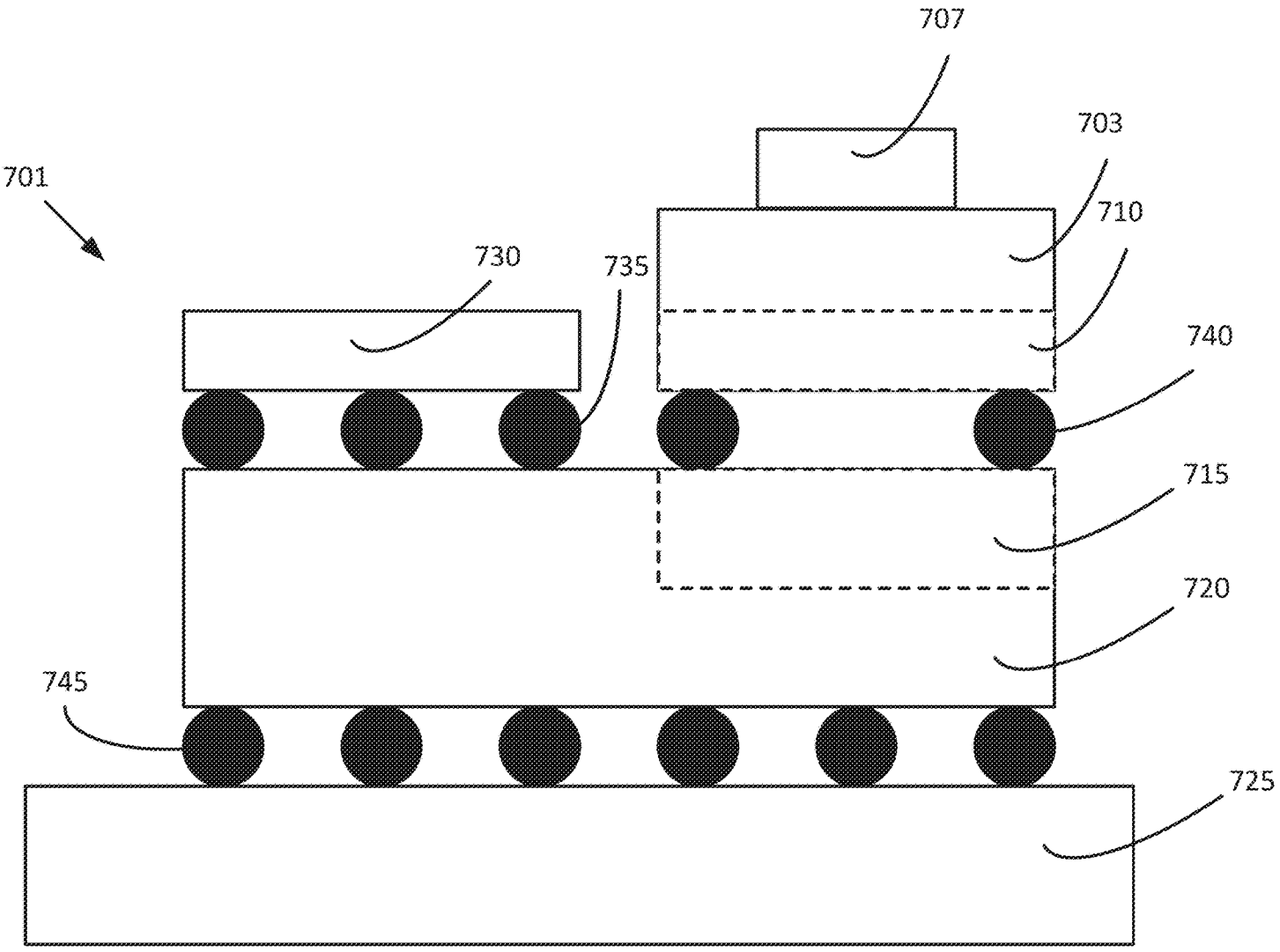
FIG. 7 depicts an alternative simplified example RF assembly that includes a dual-substrate mmWave filter, in accordance with various embodiments.

FIG. 7 depicts an alternative simplified example RF assembly 701 that includes a dual-substrate mmWave filter, in accordance with various embodiments. The RF assembly 701 may include a substrate 720 with a portion 715. The substrate 720 may be coupled with a board 725 by interconnects 745. Additionally, an active element 730 may be coupled with the substrate 720 by interconnects 735. The active element 730, interconnects 735, substrate 720, portion 715, interconnects 745, and board 725 may be respectively similar to, and share one or more characteristics with, active element 630, interconnects 635, substrate 620, portion 615, interconnects 645, and board 625.

The RF assembly may further include a top substrate 703. The top substrate 703 may be similar to, and share one or more characteristics with, substrate 720. Specifically, the top substrate 703 may be a cored or coreless substrate, and may include a plurality of layers of a dielectric substrate material similar to substrate material 245 or some other substrate material. The top substrate 703 may include one or more conductive elements such as various conductive vias, traces, microstrips, striplines, pads, etc. which may communicatively couple various elements of the top substrate 703 to one another, or may communicatively couple the various elements to other components of an electrical device to which the top substrate 703 is coupled. The top substrate 703 may additionally include one or more passive elements either positioned within, partially within, or on the top substrate 703. Such passive elements may be or include, for example, capacitors, resistors, inductors, etc.

An active element 707 may be coupled with the top substrate 703. The active element may be similar to, for example, active element 730. The active element 707 may be or may include a processing core, a memory, a logic, or some other active element of an electronic device. As shown, the active element 707 may be coupled to the top substrate 703, however in other embodiments the active element 707 may be positioned at least partially within the top substrate 703. In some embodiments, the active element 707 may be, or may be communicatively coupled with, the signal input 105 or the signal output 115 of FIG. 1.

At least a portion 710 of the top substrate 703 may be similar to, and share one or more characteristics with, substrate 210. In other words, at least a portion 615 of the substrate 620 may be generally surrounded by shielding elements such as the plate 220, vias 225, traces 230, etc. of FIGS. 2-4. In this way, a substrate such as substrate 210 may be positioned within, and be part of, a top substrate such as top substrate 703. The portions 710 and 715 may be coupled by an interconnect structure 740, which may be similar to, and share one or more characteristics with, interconnect structures 240 or 340.

Figure 8:
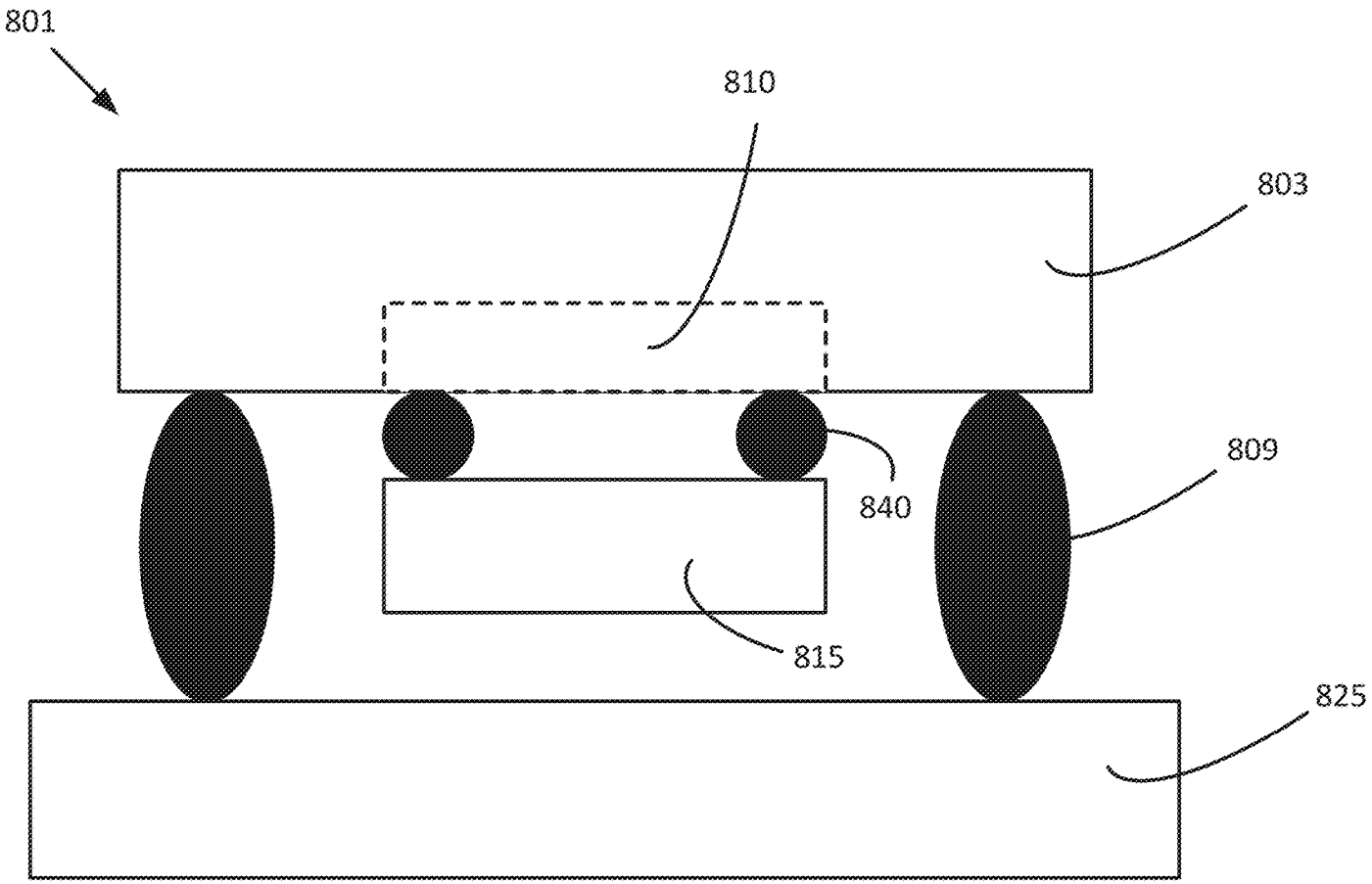
FIG. 8 depicts an alternative simplified example RF assembly that includes a dual-substrate mmWave filter, in accordance with various embodiments.

FIG. 8 depicts an alternative simplified example RF assembly 801 that includes a dual-substrate mmWave filter, in accordance with various embodiments. In FIG. 8 the "base" or "bottom" substrate may be smaller than the top substrate Specifically, the RF assembly 801 may include a substrate 815 which may be similar to, and share one or more characteristics with, substrate 215. The RF assembly 801 may further include a substrate 803 with a portion 810 which may be similar to, and share one or more characteristics with, substrate 703 and portion 710. Substrate 815 and portion 810 may be coupled together by an interconnect structure 840 which may be similar to, and share one or more characteristics with, interconnect structures 240 or 340.

The RF assembly 801 may be coupled with a board 825, which may be similar to, and share one or more characteristics of, board 625. Specifically, the substrate 803 may be coupled with the board 825 by interconnects 809. In some embodiments, the interconnects 809 may be similar to, and share one or more characteristics with, interconnects 745. In other embodiments, the interconnects 809 may include a plurality of elements. For example, in some embodiments the interconnects 809 may include a pillar physically and communicatively coupled (for example, by a solder joint) with pads of the board 825 and the substrate 803. The interconnects 809 may be some other type of interconnect, or some other combination of interconnects, in other embodiments.

As may be seen in FIGS. 6-8, an RF assembly may have a variety of variations in terms of the configuration of the RF assembly and implementation of a mmWave filter. For example, as may be seen in FIG. 6, the top substrate (e.g., substrate 610) may be smaller than the base substrate (e.g., substrate 620), and so the base substrate may form the substrate for a more complex RF SiP that includes an active element such as active element 630. Specifically, in one embodiment, the substrate 610 (which may also be referred to as a patch or an organic patch) may be generally dedicated for structures or elements related to the mmWave filter such as the various shielding elements, etc. discussed with respect to FIG. 2. By contrast, as discussed with respect to FIG. 7, the top substrate (e.g., substrate 703) may be a cored substrate (or, in other embodiments, coreless) and have components such as active element 707 mounted thereon. In this embodiment, the top substrate may be considered to be a SiP or part of a SiP. As noted, other variations may be present in other embodiments, for example as depicted in FIG. 8 where the top substrate may be larger than the bottom substrate.

Generally, the number of dielectric layers in either the top or bottom substrates may be equal to the layers required to create the resonant cavities 120 as described with respect to FIGS. 1-5. However, as may be observed for example with respect to substrate 620 and portion 615, the substrate may have more layers than the number required by the mmWave filter. Additionally, although not specifically depicted, in some embodiments one or more of the interconnects such as interconnects 645 or 745 may be replaced by additional active or passive elements coupled with the bottom substrate.

Figure 9:
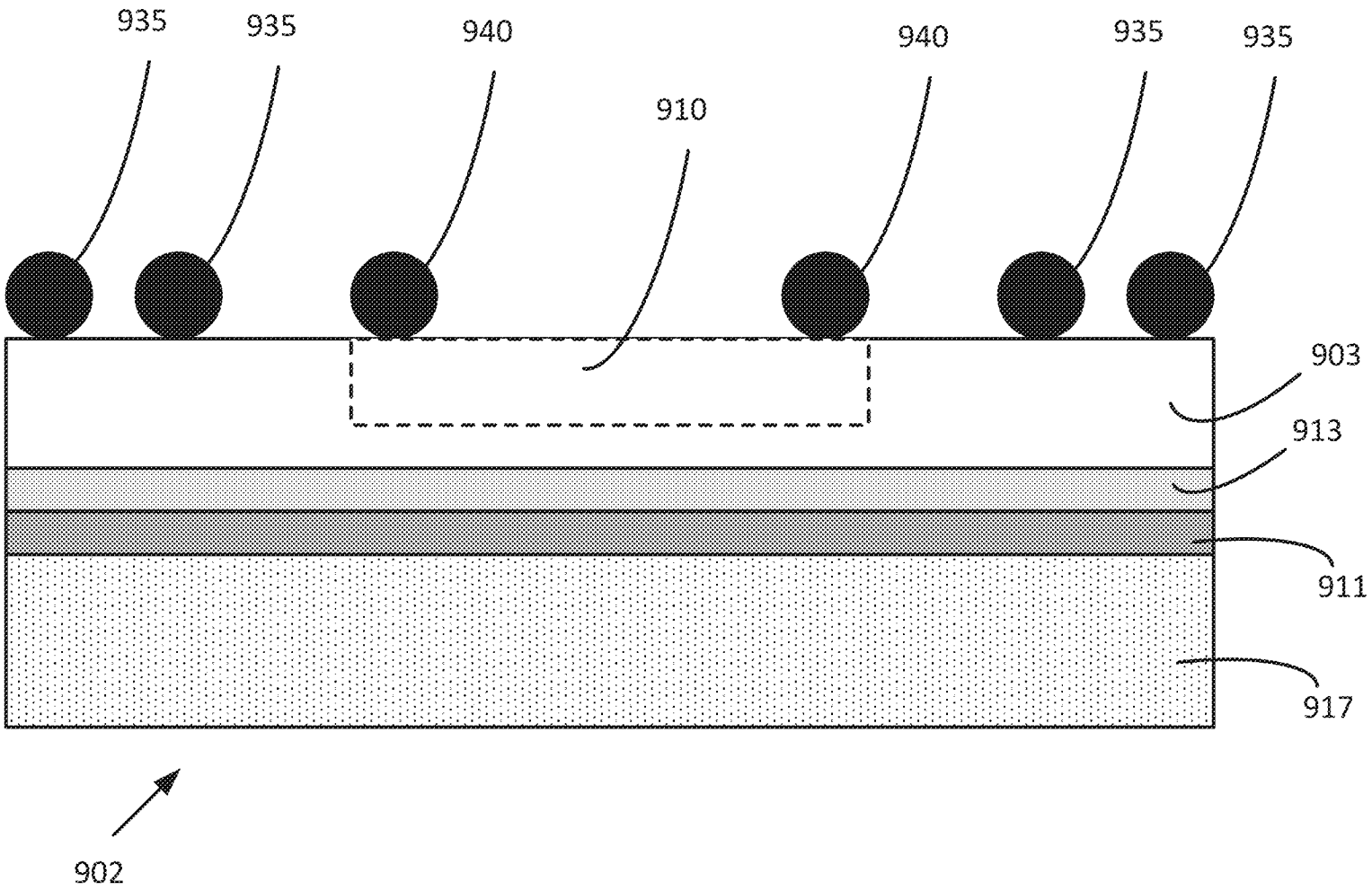
FIG. 9 depicts a simplified example wafer-level package that may be used in a dual-substrate mmWave filter, in accordance with various embodiments.

In some embodiments, a substrate such as substrate 210 may be a semiconductor die with one or more organic redistribution layers manufactured on top of a die. Such a die may be referred to as a wafer-level package type die. FIG. 9 depicts an example of such a die 902.

Specifically, the die 902 may include a mold layer 917. The mold layer 917 may be formed of, for example, a dielectric material such as a silica-filled epoxy material. An example of such a material may be a thermoset polymer.

The die 902 may further include a semiconductor layer 911. The semiconductor layer 911 may be referred to as a "front-end" of the die 902. The semiconductor layer 911 may include one or more semiconductor devices such as diodes, transistors, etc. The semiconductor devices may be formed of, for example, silicon, gallium arsenide, indium phosphide, gallium nitride, or some other material.

The die 902 may further include a redistribution layer 913, which may also be referred to as a "back-end" of the die 902. The redistribution layer 913 may include one or more conductive elements in a dielectric substrate. The conductive elements may include, for example, various pads, traces, vias, microstrips, striplines, etc. that allow for communication to or from the semiconductor devices of the semiconductor layer 911. For example, the conductive elements may allow for communication between the semiconductor elements of the semiconductor layer 911 and one or more elements or interconnects of, or coupled with a substrate 903. The substrate 903 may be similar to, and share one or more characteristics with, substrates 703 or 803. For example, the substrate 903 may include a portion 910 which may be similar to, and share one or more characteristics with, portion 710.

The die 902 may include an interconnect structure 940, which may be similar to, and share one or more characteristics with, interconnect structures 240 or 340. As can be seen, the interconnect structure 940 may be generally located at the periphery of the portion 910. The die 902 may additionally include one or more interconnects 935 which may be similar to, and share one or more characteristics with, interconnects 635, 645, or other interconnects described herein.

As may be seen, the die 902 may therefore have characteristics similar to those of a microelectronic assembly including a mold layer, a semiconductor layer, and a redistribution layer. Additionally, the die 902 may include elements that enable it to function as a portion of a mmWave filter. In this way, the die 902 may present a relatively compact and cost-effective solution for providing various functions in a RF assembly. In this way, the RF circuitry and a mmWave filter may be implemented on a single die.

It will be understood that, in some embodiments, the mold layer 917 may be omitted. For example, one manufacturing technique may include processing the substrate 903 that includes the portion 910, the interconnect structure 940, and the interconnects 935 on a semiconductor wafer-level scale. The resultant structure may then be tested after the manufacturing process. In this embodiment, the mold layer 917 may not be present.

An alternative technique may include taking a known-good-die from previous wafer-level processes and reconstitute a wafer using the mold layer 917. Organic redistribution layers may then be built on top of that reconstituted wafer to form the structure depicted in FIG. 9.

It will be understood that the various Figures herein are intended as example configurations, and other embodiments may have other variations as described above with respect to FIGS. 1-5. For example, various elements such as interconnects, substrates, etc. may be larger or smaller than depicted, particularly in relation to one another. For example, the various "portions" related to mmWave filters may be larger or smaller with respect to a housing substrate than depicted in the various Figures. Other variations may be present in other embodiments.

Figure 10:
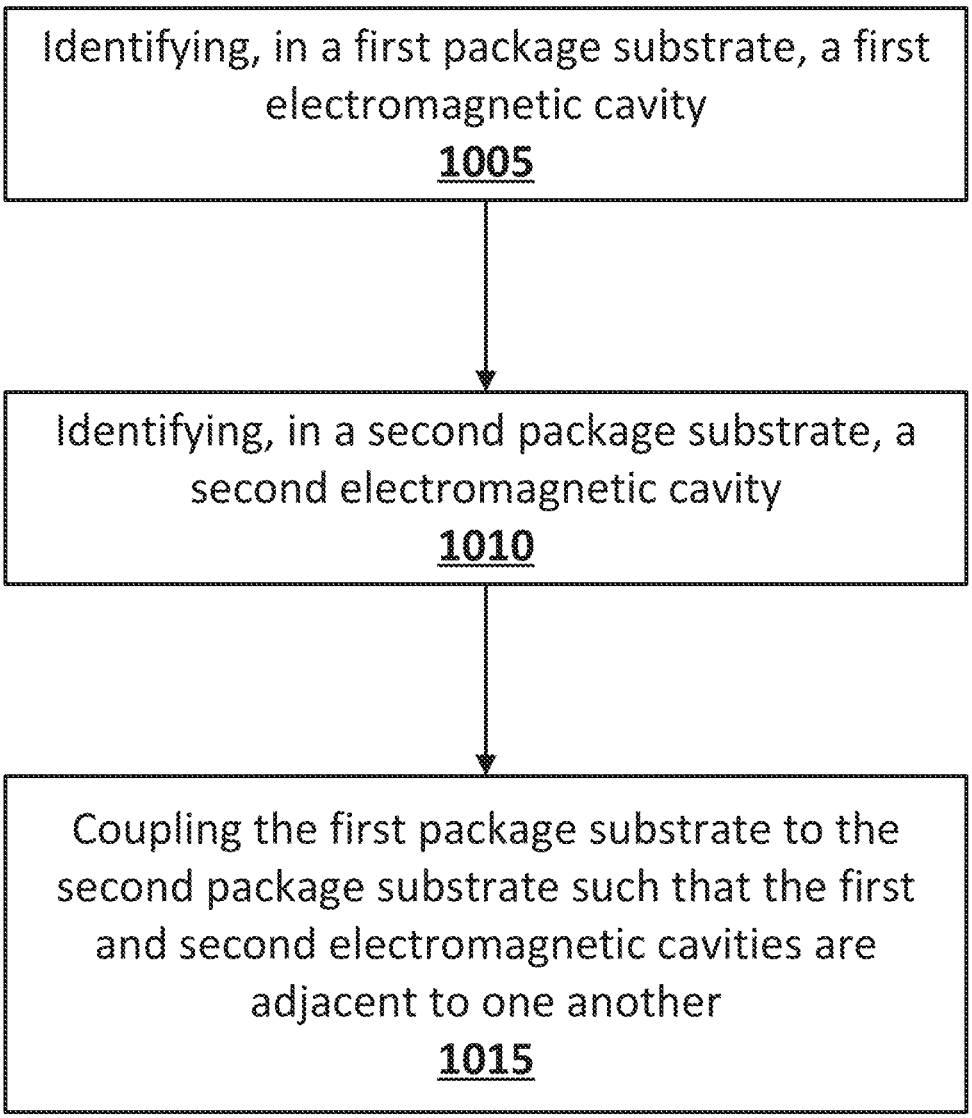
FIG. 10 depicts an example technique for manufacturing a dual-substrate mmWave filter, in accordance with various embodiments.

FIG. 10 depicts an example technique for manufacturing a dual-substrate mmWave filter, in accordance with various embodiments. Generally, the technique may be described with respect to elements of FIGS. 2-4, however it will be understood that the technique may be applicable, in whole or in part, with or without modification, to other embodiments of the present disclosure.

The technique may include identifying, at 1005, a first electromagnetic cavity in a first package substrate. The first substrate may be similar to, for example, substrate 210. The electromagnetic cavity may be, for example, the cavity formed by the various shielding elements (such as the vias 225, traces 230, plate 220, sidewall 250, etc. as described above) in the substrate 210. Specifically, the electromagnetic cavity may generally be the portion of the substrate 210 that may define one of the resonant cavities 120 as described above.

The technique may further include identifying, at 1010, a second electromagnetic cavity in a second package substrate. The second package substrate may be similar to, for example, substrate 215. The electromagnetic cavity may be, for example, the cavity formed by the various shielding elements in the substrate 215. The electromagnetic cavity may generally be the portion of the substrate that may define one of the resonant cavities 120 as described above.

The technique may further include coupling, at 1015, the first package substrate to the second package substrate such that the first and second electromagnetic cavities are adjacent to one another. This coupling may provide, for example, for a resonant cavity 120 as described above. It will be understood that this technique is intended as an example technique, and other variations may have more or fewer elements.

Figure 11:
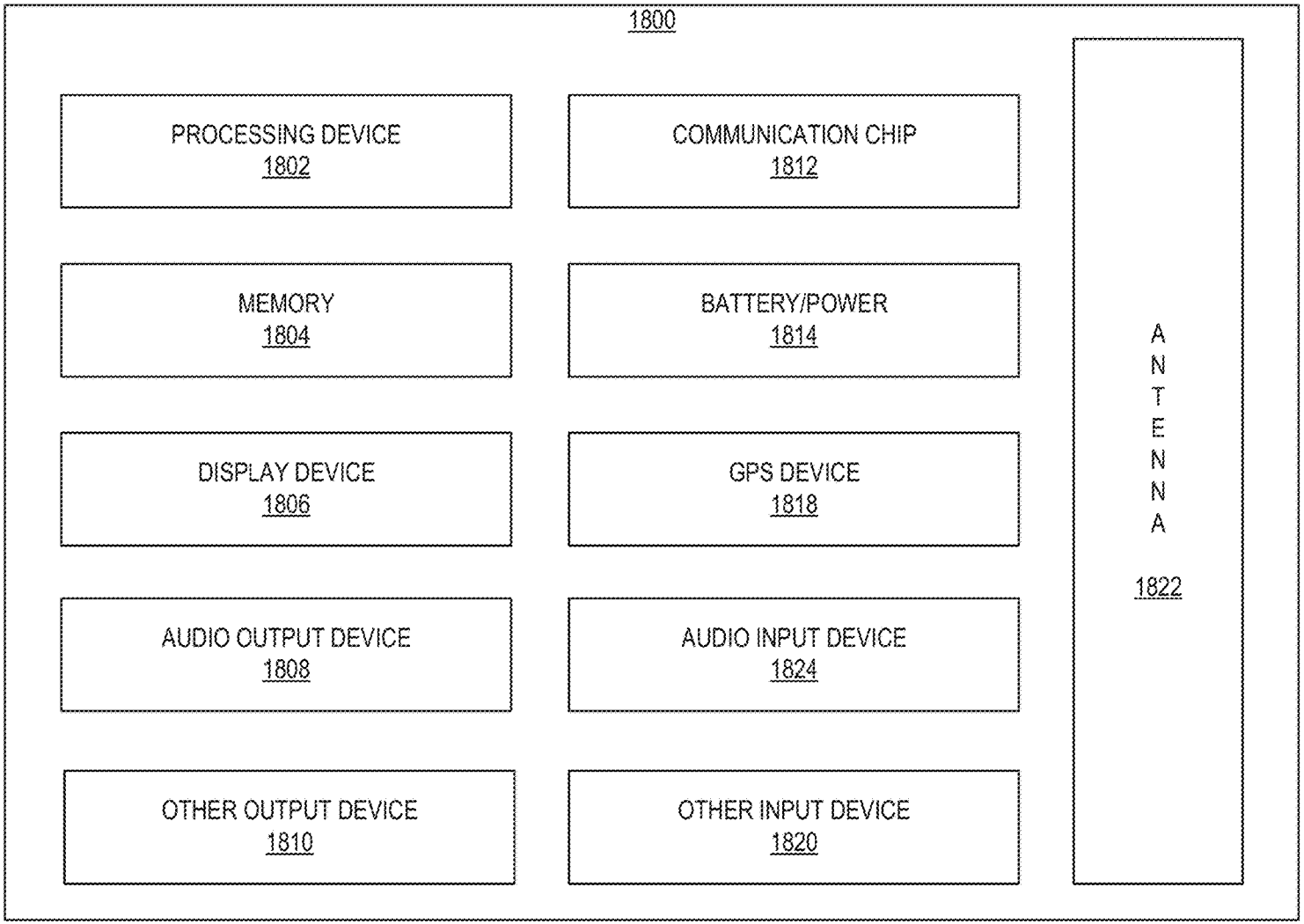
FIG. 11 is a block diagram of an example electrical device that may include a dual-substrate mmWave filter, in accordance with various embodiments.

FIG. 11 is a block diagram of an example electrical device 1800 that may include one or more dual-substrate mmWave filters, in accordance with any of the embodiments disclosed herein. For example, any suitable ones of the components of the electrical device 1800 may include one or more integrated circuit (IC) device assemblies, IC packages, IC devices, or dies discussed herein. A number of components are illustrated in FIG. 11 as included in the electrical device 1800, but any one or more of these components may be omitted or duplicated, as suitable for the application. In some embodiments, some or all of the components included in the electrical device 1800 may be attached to one or more motherboards. In some embodiments, some or all of these components are fabricated onto a single system-on-a-chip (SoC) die.

Additionally, in various embodiments, the electrical device 1800 may not include one or more of the components illustrated in FIG. 11, but the electrical device 1800 may include interface circuitry for coupling to the one or more components. For example, the electrical device 1800 may not include a display device 1806, but may include display device interface circuitry (e.g., a connector and driver circuitry) to which a display device 1806 may be coupled. In another set of examples, the electrical device 1800 may not include an audio input device 1824 or an audio output device 1808, but may include audio input or output device interface circuitry (e.g., connectors and supporting circuitry) to which an audio input device 1824 or audio output device 1808 may be coupled.

The electrical device 1800 may include a processing device 1802 (e.g., one or more processing devices). As used herein, the term "processing device" or "processor" may refer to any device or portion of a device that processes electronic data from registers and/or memory to transform that electronic data into other electronic data that may be stored in registers and/or memory. The processing device 1802 may include one or more digital signal processors (DSPs), application-specific integrated circuits (ASICs), central processing units (CPUs), graphics processing units (GPUs), cryptoprocessors (specialized processors that execute cryptographic algorithms within hardware), server processors, or any other suitable processing devices. The electrical device 1800 may include a memory 1804, which may itself include one or more memory devices such as volatile memory (e.g., dynamic random-access memory (DRAM)), nonvolatile memory (e.g., read-only memory (ROM)), flash memory, solid state memory, and/or a hard drive. In some embodiments, the memory 1804 may include memory that shares a die with the processing device 1802. This memory may be used as cache memory and may include embedded dynamic random-access memory (eDRAM) or spin transfer torque magnetic random-access memory (STT-MRAM).

In some embodiments, the electrical device 1800 may include a communication chip 1812 (e.g., one or more communication chips). For example, the communication chip 1812 may be configured for managing wireless communications for the transfer of data to and from the electrical device 1800. The term "wireless" and its derivatives may be used to describe circuits, devices, systems, methods, techniques, communications channels, etc., that may communicate data through the use of modulated electromagnetic radiation through a nonsolid medium. The term does not imply that the associated devices do not contain any wires, although in some embodiments they might not.

The communication chip 1812 may implement any of a number of wireless standards or protocols, including but not limited to Institute for Electrical and Electronic Engineers (IEEE) standards including Wi-Fi (IEEE 802.11 family), IEEE 802.16 standards (e.g., IEEE 802.16-2005 Amendment), Long-Term Evolution (LTE) project along with any amendments, updates, and/or revisions (e.g., advanced LTE project, ultra mobile broadband (UMB) project (also referred to as "3GPP2"), etc.). IEEE 802.16 compatible Broadband Wireless Access (BWA) networks are generally referred to as WiMAX networks, an acronym that stands for Worldwide Interoperability for Microwave Access, which is a certification mark for products that pass conformity and interoperability tests for the IEEE 802.16 standards. The communication chip 1812 may operate in accordance with a Global System for Mobile Communication (GSM), General Packet Radio Service (GPRS), Universal Mobile Telecommunications System (UMTS), High Speed Packet Access (HSPA), Evolved HSPA (E-HSPA), or LTE network. The communication chip 1812 may operate in accordance with Enhanced Data for GSM Evolution (EDGE), GSM EDGE Radio Access Network (GERAN), Universal Terrestrial Radio Access Network (UTRAN), or Evolved UTRAN (E-UTRAN). The communication chip 1812 may operate in accordance with Code Division Multiple Access (CDMA), Time Division Multiple Access (TDMA), Digital Enhanced Cordless Telecommunications (DECT), Evolution-Data Optimized (EV-DO), and derivatives thereof, as well as any other wireless protocols that are designated as 3G, 4G, 5G, and beyond. The communication chip 1812 may operate in accordance with other wireless protocols in other embodiments. The electrical device 1800 may include an antenna 1822 to facilitate wireless communications and/or to receive other wireless communications (such as AM or FM radio transmissions).

In some embodiments, the communication chip 1812 may manage wired communications, such as electrical, optical, or any other suitable communication protocols (e.g., the Ethernet). As noted above, the communication chip 1812 may include multiple communication chips. For instance, a first communication chip 1812 may be dedicated to shorter-range wireless communications such as Wi-Fi or Bluetooth, and a second communication chip 1812 may be dedicated to longer-range wireless communications such as global positioning system (GPS), EDGE, GPRS, CDMA, WiMAX, LTE, EV-DO, or others. In some embodiments, a first communication chip 1812 may be dedicated to wireless communications, and a second communication chip 1812 may be dedicated to wired communications.

The electrical device 1800 may include battery/power circuitry 1814. The battery/power circuitry 1814 may include one or more energy storage devices (e.g., batteries or capacitors) and/or circuitry for coupling components of the electrical device 1800 to an energy source separate from the electrical device 1800 (e.g., AC line power).

The electrical device 1800 may include a display device 1806 (or corresponding interface circuitry, as discussed above). The display device 1806 may include any visual indicators, such as a heads-up display, a computer monitor, a projector, a touchscreen display, a liquid crystal display (LCD), a light-emitting diode display, or a flat panel display.

The electrical device 1800 may include an audio output device 1808 (or corresponding interface circuitry, as discussed above). The audio output device 1808 may include any device that generates an audible indicator, such as speakers, headsets, or earbuds.

The electrical device 1800 may include an audio input device 1824 (or corresponding interface circuitry, as discussed above). The audio input device 1824 may include any device that generates a signal representative of a sound, such as microphones, microphone arrays, or digital instruments (e.g., instruments having a musical instrument digital interface (MIDI) output).

The electrical device 1800 may include a GPS device 1818 (or corresponding interface circuitry, as discussed above). The GPS device 1818 may be in communication with a satellite-based system and may receive a location of the electrical device 1800, as known in the art.

The electrical device 1800 may include another output device 1810 (or corresponding interface circuitry, as discussed above). Examples of the other output device 1810 may include an audio codec, a video codec, a printer, a wired or wireless transmitter for providing information to other devices, or an additional storage device.

The electrical device 1800 may include another input device 1820 (or corresponding interface circuitry, as discussed above). Examples of the other input device 1820 may include an accelerometer, a gyroscope, a compass, an image capture device, a keyboard, a cursor control device such as a mouse, a stylus, a touchpad, a bar code reader, a Quick Response (QR) code reader, any sensor, or a radio frequency identification (RFID) reader.

The electrical device 1800 may have any desired form factor, such as a handheld or mobile electrical device (e.g., a cell phone, a smart phone, a mobile internet device, a music player, a tablet computer, a laptop computer, a netbook computer, an ultrabook computer, a personal digital assistant (PDA), an ultra mobile personal computer, etc.), a desktop electrical device, a server device or other networked computing component, a printer, a scanner, a monitor, a set-top box, an entertainment control unit, a vehicle control unit, a digital camera, a digital video recorder, or a wearable electrical device. In some embodiments, the electrical device 1800 may be any other electronic device that processes data.

EXAMPLES OF VARIOUS EMBODIMENTS

Example 1 includes an assembly for use in a RF front-end module (FEM), wherein the assembly comprises: a first package substrate that includes a first electromagnetic cavity; and a second package substrate that is coupled to, but physically separate from, the first package substrate, wherein the second package substrate includes a second electromagnetic cavity that is adjacent to the first electromagnetic cavity, and wherein the first electromagnetic cavity and the second electromagnetic cavity together form a first millimeter wave (mmWave) resonant cavity of a mmWave filter.

Example 2 includes the assembly of example 1, further comprising a second mmWave resonant cavity adjacent to the first mmWave resonant cavity.

Example 3 includes the assembly of example 2, wherein an output of the first mmWave resonant cavity is adjacent to an input of the second mmWave filter.

Example 4 includes the assembly of example 1, further comprising a dielectric material between the first package substrate and the second package substrate.

Example 5 includes the assembly of example 4, wherein the dielectric material is air.

Example 6 includes the assembly of example 4, wherein the dielectric material is a mold material or an underfill material.

Example 7 includes the assembly of any of examples 1-6, wherein the mmWave filter has a z-height, as measured in a direction perpendicular to a direction of propagation of a signal through the mmWave filter, of between 200 micrometers ("microns") and 800 microns.

Example 8 includes the assembly of any of examples 1-6, wherein the first package substrate and the second package substrate are physically coupled together by a solder interconnect structure.

Example 9 includes the assembly of example 8, wherein the solder interconnect structure includes a single solder interconnect element.

Example 10 includes the assembly of example 8, wherein the solder interconnect structure includes a plurality of solder interconnect elements.

Example 11 includes the assembly of any of examples 1-6, wherein the first electromagnetic cavity includes a plurality of layers of dielectric material of the first package substrate.

Example 12 includes the assembly of example 11, wherein the dielectric material of the first package substrate has a loss tangent of less than 0.004.

Example 13 includes the assembly of example 11, wherein the dielectric material of the first package substrate has a k-value greater than 3.2.

Example 14 includes a millimeter wave (mmWave) filter for use in a RF FEM, wherein the mmWave filter comprises: a first electromagnetic cavity in a first substrate; and a second electromagnetic cavity in a second substrate, wherein the first and second electromagnetic cavities are adjacent to one another and together are to filter a mmWave electromagnetic signal.

Example 15 includes the mmWave filter of example 14, wherein the first substrate is a cored substrate.

Example 16 includes the mmWave filter of example 15, wherein the first substrate includes an active component related to RF operation of the RF FEM.

Example 17 includes the mmWave filter of example 15, wherein the first substrate is coupled to a board of a computing device, and the first substrate is between the second substrate and the board.

Example 18 includes the mmWave filter of example 15, wherein the first substrate is coupled to a board of a computing device, and wherein the second substrate is between the first substrate and the board.

Example 19 includes the mmWave filter of example 15, wherein the second substrate is a cored substrate.

Example 20 includes the mmWave filter of any of examples 14-19, wherein the first substrate is a coreless substrate.

Example 21 includes the mmWave filter of example 20, wherein the first substrate is coupled to the second substrate, and the second substrate is coupled with a board of a computing device.

Example 22 includes the mmWave filter of any of examples 14-19, wherein the first substrate is a wafer-level-package (WLP) die that includes RF circuitry related to operation of the RF FEM.

Example 23 includes a method of forming a millimeter wave (mmWave) filter for use in a RF FEM, wherein the method comprises: identifying, in a first package substrate, a first electromagnetic cavity; identifying, in a second package substrate, a second electromagnetic cavity; and coupling the first package substrate to the second package substrate such that the first and second electromagnetic cavities are adjacent to one another.

Example 24 includes the method of example 23, wherein coupling the first and second package substrates includes coupling the first package substrate to the second package substrate by a solder interconnect structure.

Example 25 includes the method of example 24, wherein the solder interconnect structure includes a single solder interconnect element.

Example 26 includes the method of example 24, wherein the solder interconnect structure includes a plurality of solder interconnect elements.

Example 27 includes the method of example 26, wherein the method further comprises spacing respective solder interconnect elements of the plurality of solder interconnect elements such that they form an electromagnetic shield around the mmWave filter.

Example 28 includes the method of any of examples 23-27, further comprising: identifying, in the first package substrate, a third electromagnetic cavity that is adjacent to the first electromagnetic cavity; and identifying, in the second package substrate, a fourth electromagnetic cavity that is adjacent to the second electromagnetic cavity; wherein coupling the first package substrate to the second package substrate includes placing the third and fourth electromagnetic cavities adjacent to one another.

Various embodiments may include any suitable combination of the above-described embodiments including alternative (or) embodiments of embodiments that are described in conjunctive form (and) above (e.g., the "and" may be "and/or"). Furthermore, some embodiments may include one or more articles of manufacture (e.g., non-transitory computer-readable media) having instructions, stored thereon, that when executed result in actions of any of the above-described embodiments. Moreover, some embodiments may include apparatuses or systems having any suitable means for carrying out the various operations of the above-described embodiments.

The above description of illustrated embodiments, including what is described in the Abstract, is not intended to be exhaustive or limiting as to the precise forms disclosed. While specific implementations of, and examples for, various embodiments or concepts are described herein for illustrative purposes, various equivalent modifications may be possible, as those skilled in the relevant art will recognize. These modifications may be made in light of the above detailed description, the Abstract, the Figures, or the claims.

The invention claimed is:

1. An assembly for use in a radio frequency (RF) front-end module (FEM), wherein the assembly comprises:

a first package substrate that includes a first electromagnetic cavity; and a second package substrate that includes a second electromagnetic cavity that is aligned with the first electromagnetic cavity, wherein:

the second package substrate is coupled to the first package substrate by an interconnect structure that forms a third electromagnetic cavity between the first package substrate and the second package substrate, and the first electromagnetic cavity and the second electromagnetic cavity together form a first millimeter wave (mmWave) resonant cavity of a mmWave filter.

2. The assembly of claim 1, further comprising a second mmWave resonant cavity adjacent to the first mmWave resonant cavity.

3. The assembly of claim 1, wherein the mmWave filter has a z-height, as measured in a direction perpendicular to a direction of propagation of a signal through the mmWave filter, of between 200 micrometers ("microns") and 800 microns.

4. The assembly of claim 1, wherein the first substrate includes an active component related to RF operation of the RF FEM.

5. The assembly of claim 1, wherein the interconnect structure includes a single interconnect element.

6. The assembly of claim 1, wherein the interconnect structure includes a plurality of interconnect elements.

7. The assembly of claim 1, wherein the first electromagnetic cavity includes a plurality of layers of dielectric material of the first package substrate.

8. The assembly of claim 7, wherein the dielectric material of the first package substrate has a loss tangent of less than 0.004.

9. The assembly of claim 7, wherein the dielectric material of the first package substrate has a k-value greater than 3.2.

10. The assembly of claim 1, wherein the first mmWave resonant cavity of the mmWave filter further includes a portion of the third electromagnetic cavity that is between the first electromagnetic cavity and the second electromagnetic cavity.

11. A millimeter wave (mmWave) filter for use in a radio frequency (RF) front-end module (FEM), wherein the mmWave filter comprises:

a first electromagnetic cavity in a first substrate, wherein the first substrate is a wafer-level-package (WLP) die that includes an active component related to RF operation of the RF FEM; and a second electromagnetic cavity in a second substrate, wherein the first and second electromagnetic cavities are adjacent to one another and together are to filter a mmWave electromagnetic signal.

12. The mmWave filter of claim 11, wherein the first substrate is a cored substrate.

13. The mmWave filter of claim 12, wherein the first substrate is coupled to a board of a computing device, and the first substrate is between the second substrate and the board.

14. The mmWave filter of claim 12, wherein the first substrate is coupled to a board of a computing device, and wherein the second substrate is between the first substrate and the board.

15. The mmWave filter of claim 11, wherein the mmWave filter has a z-height, as measured in a direction perpendicular to a direction of propagation of a signal through the mmWave filter, of between 200 micrometers and 800 micrometers.

16. The mmWave filter of claim 11, wherein the second substrate is physically coupled to the first substrate by a plurality of interconnect elements.

17. The mmWave filter of claim 11, wherein the first electromagnetic cavity includes a plurality of layers of a dielectric material of the first substrate, and wherein the dielectric material has a k-value greater than 3.2.

18. A method of forming a millimeter wave (mmWave) filter for use in a radio frequency (RF) front-end module (FEM), the method comprising:

forming a first electromagnetic cavity in a first package substrate;

forming a second electromagnetic cavity in a second package substrate; and coupling the first package substrate to the second package substrate by a solder interconnect structure that includes a plurality of solder interconnect elements, such that the first and second electromagnetic cavities are adjacent to one another.

19. The method of claim 18, further comprising:

forming, in the first package substrate, a third electromagnetic cavity that is adjacent to the first electromagnetic cavity; and forming, in the second package substrate, a fourth electromagnetic cavity that is adjacent to the second electromagnetic cavity, wherein coupling the first package substrate to the second package substrate includes placing the third and fourth electromagnetic cavities adjacent to one another.

* * * * *